United States Patent [19]

McQuillan

[11] 4,256,309

[45] Mar. 17, 1981

[54] BOARD GAME APPARATUS

[76] Inventor: Philip J. McQuillan, 601 Mikes Pike, Flagstaff, Ariz. 86001

[21] Appl. No.: 957,920

[22] Filed: Nov. 6, 1978

Related U.S. Application Data

[63] Continuation of Ser. No. 820,870, Aug. 1, 1977, abandoned.

[51] Int. Cl.[3] ..... A63F 3/02

[52] U.S. Cl. ..... 273/258; 273/261

[58] Field of Search ..... 273/258, 261, 262, 243, 273/236, 255

[56] References Cited

U.S. PATENT DOCUMENTS

| | | | |
|---|---|---|---|
| 1,433,336 | 10/1922 | Beresford | 273/258 |
| 3,860,241 | 1/1975 | Leftin | 273/255 |
| 3,995,704 | 12/1976 | Blickman | 273/285 X |

FOREIGN PATENT DOCUMENTS

| | | | |
|---|---|---|---|
| 8824 | of 1896 | United Kingdom | 273/258 |
| 514846 | 11/1939 | United Kingdom | 273/262 |

OTHER PUBLICATIONS

*Treasures of Tutankaman,* 1976, Catalogue of Exhibition, Metropolitan Museum of Art.

*Primary Examiner*—Richard C. Pinkham
*Assistant Examiner*—Scott L. Brown
*Attorney, Agent, or Firm*—Martin L. Stoneman; Diamond C. Ascani

[57] ABSTRACT

A game device consisting of a rectangular playing board incorporating twenty-seven playing areas or squares arranged in nine rows and three columns. The board is visibly marked for division in three equal sectors of nine squares each. There are two sets of nine playing pieces or tokens marked with the numerals "1", "2", and"3", so that each of two players at opposite ends of the board longitudinally may place pieces on the equal sector near that player, the row nearest the player having the highest numbered tokens, the next row having the next highest numbered tokens, and the third row having the lowest numbered tokens, whereby pieces are moved forward in play either directly or diagonally or both according to the numeral indicated on the particular token.

5 Claims, 9 Drawing Figures

BOARD GAME APPARATUS

BACKGROUND OF THE INVENTION

This is a continuation application from applicant's prior U.S. patent application Ser. No. 820,870, filed Aug. 1, 1977, now abandoned.

This invention relates to a game device.

More particularly, the invention concerns a board game device of the type including tokens for movement on said board by each of two players.

In a further aspect, the invention concerns a board game device of a non-trivial nature wherein the outcome of the game is entirely dependent on the skill of the players, since, in keeping with the preferred set of rules, there is no element of chance or luck.

Among the numerous examples of board games which have been devised, there are in fact very few which are strictly games of skill, that is, relying totally on the degree of skill of the players. The best previous examples of such games are chess and checkers, although neither of these games can be construed as the logical antecedent of the improved board game apparatus described herein. The ancient Egyptian game of Senet may bear some resemblance to the present invention. However, among other differences, it does not appear that there were ever more than two different kinds of playing pieces associated with that game.

Many examples of game devices are in the prior art which involve amusement factors or a mix or balance of chance factors and skill factors. With respect to the board game apparatus of Moritz (U.S. Pat. No. 3,863,927) that disclosure not only does not show a board divided into three sectors (as in the present invention) but it requires the association of numerical value with the discrete areas of the board played upon. Also, among many other differences, the Moritz game is played with more than three identifying numerical indicia. Other game devices of the prior art comprising game pieces and a patterned board are exemplified, for example by those such as shown in U.S. Pat. No. 3,632,111, to Wicks, U.S. Pat. No. 3,633,913, to Solimene, U.S. Pat. No. 3,995,704, to Blickman, U.S. Pat. No. 1,433,336, to Beresford, and U.S. Pat. No. 3,640,537, to Klaner et al. Another example is United Kingdom Pat. No. 8824 to Howell.

SUMMARY OF THE INVENTION

It is the primary object of the present invention to provide an improved game device.

Another object of the present invention is the provision of a board game apparatus adapted for use as a skill game between two players.

Still another object is to provide a game device including game tokens whose movement corresponds to numerical indicia on the token when used according to the preferred set of game rules.

Yet still another object of the present invention is the provision of a board game apparatus of the above type having a high degree of interest and skill for use by the players, which is relatively inexpensive to manufacture, and which has a high degree of durability and serviceability.

Briefly, to accomplish the desired objectives of the present invention in accordance with the presently preferred embodiment thereof, there is provided a game comprising a playing board; means dividing the playing board into three sectors, the first sector being interposed between the second sector and the third sector; means partitioning each sector into a plurality of discrete areas, the number of discrete areas in the second sector being equal to the number of discrete areas in the third sector; a first set and a second set of playing pieces, each such respective set of playing pieces including a plurality of game tokens adapted to be received in the discrete areas of the second and third sectors, respectively; the number of tokens in each such set of playing pieces being equal to the number of discrete areas in the second sector (thus also equal to the number of discrete areas in the third sector); means whereby the first set of playing pieces is visually distinguishable from the second set of playing pieces; token indicia means for identifying each token of the respective sets of playing pieces, the token indicia means including first, second, and third identifying indicia equally allocated among the tokens in each such set of playing pieces. The discrete areas are preferably disposed in columns and rows, the second and third sectors each preferably having three rows and all of the columns extending through all of the three sectors. The partitioning means preferably includes intersecting lines imprinted on the playing board to define rectangular discrete areas. The three sectors are preferably divided by two parallel lines imprinted in greater thickness than the other intersecting lines. The first sector (the central sector) preferably has three rows. Thus the preferred playing board has three columns and nine rows forming twenty-seven total discrete areas, nine discrete areas in each sector. It is also highly preferred that the first, second, and third identifying indicia consist, respectively, of the numerals "1", "2", and "3".

BRIEF DESCRIPTION OF THE DRAWINGS

Further and more specific objects and advantages of the present invention will become more readily apparent to those skilled in the art from the following detailed description thereof taken in connection with the drawings, in which.

DETAILED DESCRIPTION OF THE PREFERRED EMBODIMENT

Figure 1:
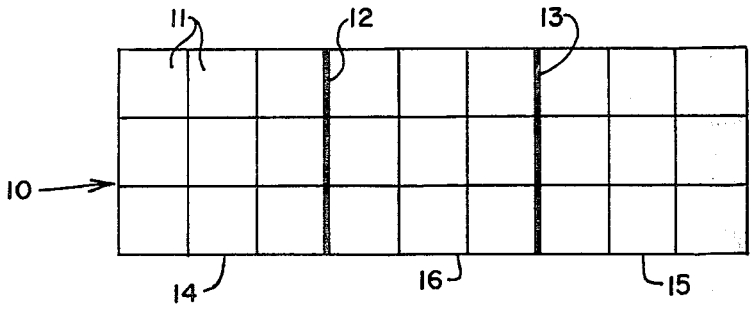
FIG. 1 is a plan view of the surface of the preferred embodiment of the playing board of the present invention.
Figure 2:
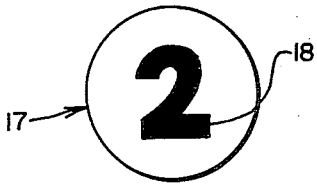
FIG. 2 is a top view illustrating a preferred form of a token or playing piece of the present invention.
Figure 3:
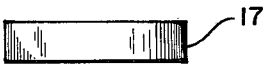
FIG. 3 is a side view of the token of FIG. 2.

Turning now to the drawings, in which the reference numerals indicate corresponding elements throughout the several views, FIG. 1 shows the preferred playing board 10 of the present invention. It is seen that playing board 10 includes 27 discrete areas or playing squares 11 defined and ordered in nine rows and three columns by the intersecting lines illustrated. Sector dividing lines 12 and 13 are of an increased thickness and serve to visually define sectors 14, 15, and 16. Each sector 14, 15, and 16, as shown, includes nine playing squares 11. A preferred form of the playing pieces or tokens 17 of the present invention is illustrated by FIGS. 2 and 3. As shown, token 17 is disc shaped and includes an indicium 18 thereon, preferably numerical as shown.

Figure 4:
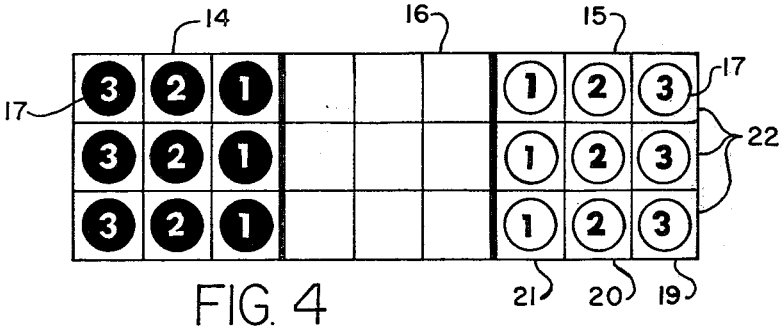
FIG. 4 is a plan view illustrating the preferred playing board and tokens of the present invention arranged for the start of the game to be played in accordance with preferred rules.

FIG. 4 illustrates the tokens 17 of the present invention in place for the start of the game according to the presently preferred game rules. The set of playing pieces or tokens shown upon sector 15 are the playing pieces of one of the players and are differentiated, as by color, from the playing pieces 17 of the other player, shown in sector 14. It is seen that each player has exactly nine tokens 17, three tokens marked with the numeral "3", three tokens marked with the numeral "2", and three tokens marked with the numeral "1". The descriptions herein concerning the method and rules of the game played with the game device of the present invention all refer to the game rules presently preferred.

It is seen that the tokens 17 marked "3" are, at the beginning of the game, placed upon the row 19 closest to the player. Also, as shown, the tokens 17 marked with the figure "2" are placed in the next adjacent row, row 20. The tokens 17 marked "1" are placed in the middlemost row of the end sectors 14 and 15, row 21. It is seen that the three columns 22 extend throughout sectors 14, 15, and 16.

The legal moves available for the tokens of the present invention will now be explained with reference to FIG. 5, which illustrates such legal moves by means of arrows. A token 17 bearing the numeral "3" may be moved forward along a column two squares and to the side along a row one square, or alternatively, first one square to the side along a row and then two squares forward. Token 23 is a token of this type and the arrows, as at 24, leading from token 23 illustrate the variety of moves available to a token marked "3" as hereinabove described. It is seen that token 23 may be moved along various paths and will finally come to rest in either of the squares 25.

Figure 5:
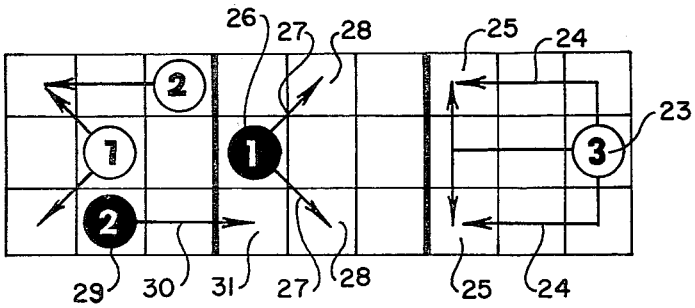
FIG. 5 is a view similar to that of FIG. 4 illustrating the moves available to the various tokens of the present invention in accordance with the preferred rules.

Similarly, with reference to FIG. 5, token 26, of the type containing the numeral "1", may only move diagonally forward one space, as illustrated by arrows 27, and thus may be moved only to either of squares 28. Similarly, token 29, containing the numeral "2", may be moved only two squares forwardly, as illustrated by arrow 30, and will end up in square 31. It is particularly pointed out that the playing pieces or tokens 17 of the present invention may be moved only forwardly, that is, in the direction of the initial placement of the opponent's pieces. All tokens bearing the numeral "1" are moved diagonally one space in the forward direction; all tokens bearing the numeral "2" are moved forwardly exactly two squares; and the more intricate movement of tokens bearing the numeral "3" has already been described.

According to the preferred rules, the players alternate moves, and neither player is permitted to move one of that player's own tokens through or to a square occupied by another of that player's own tokens. However, when a player moves his own token through or to a square upon which is located a token of that player's opponent, that player then displaces the token of the opponent to a square anywhere on the row where the displaced token was located at the start of the game. If there are no squares vacant on the starting row of the displaced opponent's token, the player may choose any square in the opponent's "home" sector on which to place the displaced token. A capture, in which an opponent's piece is removed from the board permanently, can only occur when that piece is captured somewhere on its starting row. All other confrontations result in a displacement, in which the opponent's piece is removed from the contested square and placed back on the board, as described, by the attacker. (It is mentioned that if all nine starting squares are occupied by pieces, then a displaced piece may not be returned to the board from any position and stays off the board for the rest of the game, a type of "cheap capture").

According to the preferred set of rules, any piece may either displace or capture any opponent's piece, with one exception: a "3"-piece may not displace nor may it capture an opposing "3"-piece. Additionally, a player may not attack an opposing piece with the same token of the player twice in a row; the player must wait at least one turn before reattacking. Also, a piece that has been attacked and displaced may not counterattack the piece that had displaced it without allowing at least one turn to pass first.

According to the preferred set of rules, the object of the game is to try to gain control of or strategically occupy the center sector of the game board. There are exactly four different ways to win.

Figure 6:
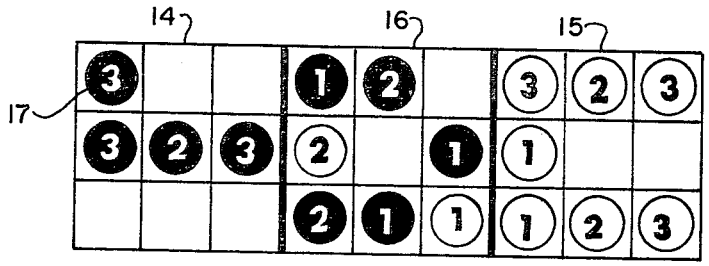
FIGS. 6, 7, 8, and 9 are views similar to FIG. 4 illustrating four ways a player playing the game of the present invention may win in accordance with the preferred rules.

A first way to win, illustrated with reference to FIG. 6, is for a player to advance five of his pieces so that they occupy five of the nine squares in the center sector. With reference to FIG. 6, therefore, it is seen that the player of the darker pieces wins.

Figure 7:
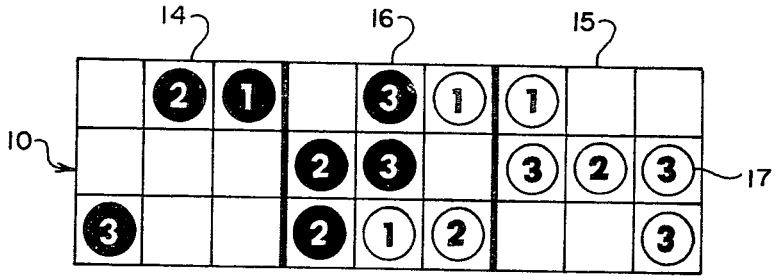

Another way to win is illustrated with reference to FIG. 7. A player wins if he advances ten points worth of pieces into the center sector. Thus, it is seen with reference to FIG. 7 that the player with the darker pieces wins.

Figure 8:
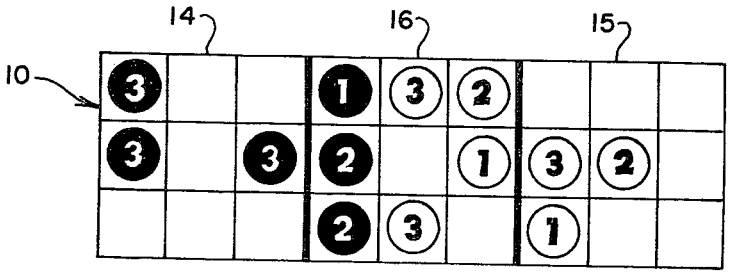

With reference to FIG. 8, a player can win if he succeeds in blocking his opponent's pieces so that the opponent has no possible move. Assuming it is the turn of the player with the lighter pieces to play, that player has no possible move; so the player of the darker pieces wins.

Figure 9:
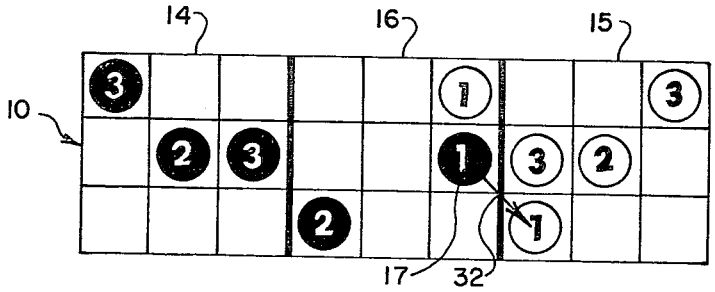

The last way to win according to the preferred set of rules is seen with reference to FIG. 9. If a player makes a move that reduces his opponent to less than five playable pieces and also less than ten points worth of pieces, the player wins. It is seen from FIG. 9, that if the player with the darker pieces captures the lighter "1"-piece with his "1"-piece by movement as indicated by arrow 32, that player reduces the player of the lighter pieces to nine points and four pieces; so the player of the dark pieces wins.

A provision is made in the preferred set of rules for the occurrence of a stalemate. If it should occur that both players are simultaneously reduced, in a single move, to a point where they both have less than five countable pieces and also less than ten countable points, then they each have ten moves in which to win by blocking. If neither player is able to cause a block within ten moves, then the game is a stalemate.

Other uses and rules for the disclosed game equipment will be apparent. It should be appreciated that the foregoing are exemplary rules for the present game for the purposes stated.

The present embodiment of this invention is to be considered in all respects as illustrative and not restrictive, the scope of the invention being indicated by the appended claims rather than by the foregoing description and all changes which come within the meaning and range of equivalency of the claims are therefore intended to be embraced thereby.

I claim:

1. A game comprising:

(a) a playing board, (b) means imprinted on said playing board for dividing said board into three sectors, the first said sector being interposed between the second said sector and the third said sector, (c) means imprinted on said playing board for partitioning each said sector into a plurality of discrete areas disposed in columns and rows, said sectors each having three rows, and said playing board having three columns, all said columns extending through all of said three sectors, thereby forming twenty-seven discrete areas, nine discrete areas in each said sector, (d) a first set and a second set of playing pieces, each said respective set of playing pieces including a plurality of game tokens adapted to be received in the discrete areas of said second and third sectors, respectively, (e) the number of tokens in each said set of playing pieces being equal to the number of discrete areas in all said sectors, (f) means whereby said first set of playing pieces is visually distinguishable from said second set of playing pieces, (g) token indicia means for identifying each token of said respective sets of playing pieces, said token indicia means including first, second, and third identifying indicia equally allocated among said tokens in each said set of playing pieces.

2. The game of claim 1 wherein said partitioning means include intersecting lines imprinted on said playing board to define rectangular discrete areas.

3. The game of claim 2 wherein said dividing means comprises two parallel ones of said intersecting lines, said two parallel ones being visually distinguishable from the other of said intersecting lines.

4. The game of claim 3 wherein said two parallel ones are lines imprinted in greater thickness than the other of said intersecting lines.

5. The game of claim 1 wherein said first, second, and third identifying indicia comprise, respectively, the numerals "1", "2", and "3".

* * * * *